US011448476B1

(12) United States Patent
Davis

(10) Patent No.: US 11,448,476 B1
(45) Date of Patent: Sep. 20, 2022

(54) HAMMER AND TRIGGER PIN REMOVAL TOOL

(71) Applicant: Exponential Innovation IP Holdings LLC, Freehold, NJ (US)

(72) Inventor: Von Davis, Freehold, NJ (US)

(73) Assignee: Exponential Innovation IP Holdings LLC, Freehold, NJ (US)

( * ) Notice: Subject to any disclaimer, the term of this patent is extended or adjusted under 35 U.S.C. 154(b) by 0 days.

(21) Appl. No.: 17/221,055

(22) Filed: Apr. 2, 2021

(51) Int. Cl.
*F41A 11/00* (2006.01)
*B25B 27/14* (2006.01)

(52) U.S. Cl.
CPC ..... *F41A 11/00* (2013.01); *B25B 27/14* (2013.01)

(58) Field of Classification Search
CPC ..... B23P 27/00; B23P 27/14; B23P 19/00; Y10T 29/537; F41A 11/00
USPC ..... 29/270, 275, 278; 254/131; 7/138, 170; 42/13, 49.02, 75.03, 75.04, 77, 108
See application file for complete search history.

(56) References Cited

U.S. PATENT DOCUMENTS

| | | | | |
|---|---|---|---|---|
| 2,776,108 | A | 1/1957 | Sherman | |
| 4,837,963 | A * | 6/1989 | Slappey, Jr. | B25B 27/02 42/90 |
| D350,270 | S | 9/1994 | Jensen | |
| 5,695,172 | A | 12/1997 | Hreha | |
| 5,875,535 | A | 3/1999 | Canoy | |
| D419,848 | S | 2/2000 | Kirby | |
| 6,351,881 | B1 | 3/2002 | Peckich et al. | |
| 6,901,644 | B1 | 6/2005 | Rich | |
| D568,124 | S | 5/2008 | Stevens, Sr. | |
| 7,971,329 | B1 * | 7/2011 | Brohard | B25B 27/04 29/275 |
| 8,850,738 | B2 * | 10/2014 | Silver | F41C 27/00 42/108 |
| D732,911 | S | 6/2015 | Schiele et al. | |
| D741,672 | S | 10/2015 | Bryant | |
| 9,427,109 | B2 | 8/2016 | Edwins | |
| D869,303 | S | 12/2019 | Tiedeken | |
| D880,969 | S | 4/2020 | Lenart | |
| D905,364 | S | 12/2020 | Zemel et al. | |
| 2014/0237794 | A1 | 8/2014 | Gosselin | |
| 2017/0014982 | A1 | 1/2017 | Rieschi | |

* cited by examiner

*Primary Examiner* — Lee D Wilson
*Assistant Examiner* — Alberto Saenz
(74) *Attorney, Agent, or Firm* — Lerner, David, Littenberg, Krumholz & Mentlik, LLP

(57) ABSTRACT

A method of removing a trigger assembly from a firearm includes placing a projection of a pin removal tool against a first end of a trigger pin of a firearm. The projection of the pin removal tool extends from a first end of a handle of the pin removal tool. The projection is then pushed against the pin so as to cause the pin to partially unseat from its position within the firearm. The pin removal tool is then turned around and the head is engaged to the pin between the first end and a second end thereof via a notch of the head. The pin removal tool is pulled so that the trigger pin is removed from the firearm so as to release a trigger assembly which is at least partially held within the firearm by the trigger pin.

12 Claims, 6 Drawing Sheets

HAMMER AND TRIGGER PIN REMOVAL TOOL

BACKGROUND OF THE INVENTION

Mechanical devices often have one or more components that are secured to a structure, such as a housing, via one or more pins. As an example, firearms typically have several components that may be secured to a receiver, barrel, or the like via one or more pins. Firearms are often disassembled and reassembled for maintenance or modification which may involve the removal of such pins.

Pin removal is commonly performed via pin punches which are repeatedly impacted against a pin until the pin falls out of its recess. However, it is common for a pin punch on its final impact to propel the pin out of the user's view making it difficult to find. Also, repeated impacts have a tendency to deform a pin over time. Therefore, further improvements are desirable.

BRIEF SUMMARY OF THE INVENTION

In one aspect of the present disclosure, a method of removing a pin from a firearm includes placing a projection of a pin removal tool against a first end of a pin of a firearm. The projection of the pin removal tool extends from a first end of a handle of the pin removal tool. The method also includes pushing the projection against the pin to cause the pin to partially unseat from its position within the firearm, engaging the pin between the first end and a second end thereof with a notch of the head of the pin removal tool, and removing the pin from the firearm by pulling on the pin removal tool.

Additionally, the pin removal tool may have a longitudinal axis extending from a first terminal end to a second terminal end thereof. The projection may extend along the longitudinal axis and define the first terminal end of the pin removal tool. The head may define the second terminal end of the pin removal tool. The head may have a first side, a second side, and a wall that extends between the first and second sides. The first side of the head may have a planar surface oriented transverse to the longitudinal axis. The notch may extend into the wall and through the first and second sides of the head. The notch may taper inwardly in a direction toward the longitudinal axis. The pin removal tool may be made from a softer material than the trigger pin. Also, the step of engaging the pin may include inserting a wedge into a notch of the pin, the wedge defining at least a portion of a perimeter of the notch. The pin may be a trigger pin disposed in a lower receiver of the firearm and removing the pin from the firearm releases a trigger assembly within the lower receiver.

In another aspect of the present disclosure, a method of removing a pin from a device includes placing a projection of a pin removal tool against a first end of a pin of a device. The projection of the pin removal tool extends from a first end of a handle of the pin removal tool. The method also includes pushing the projection against the pin to cause the pin to partially unseat from its position within the device, engaging the pin between the first end and a second end thereof with a notch of the head of the pin removal tool, and pulling on the pin removal tool and the pin to remove the pin from the device.

Additionally, the head may include a front face, a rear face, and a sidewall extending therebetween. The front face may be planar, and the projection may extend along a longitudinal axis oriented orthogonal to the planar front face.

In a further aspect of the present disclosure, a method of making a pin removal tool, includes forming a tool shape from a blank of metal material. The tool shape defines a head and a handle. The head has a notch. The method also included forming a projection from the blank of metal material so that the projection extends from the handle, and bending the head so that the head is oriented at an angle relative to a longitudinal axis of the handle.

Additionally, the notch may be formed at an end of the head remote from the handle. The blank of metal material may be a sheet of metal material, and forming the tool shape may include stamping the tool shape from the sheet of metal material. Also, the steps of forming the tool shape and forming the projection may be performed concurrently. Further, forming the projection from the sheet of metal material may include bending a portion of the metal material at an end of the handle remote from the head into an elongate projection. Still further, forming the tool shape may include cutting the metal material to form the portion that forms the projection. The method may also include forming elongate ribs in the handle and head.

BRIEF DESCRIPTION OF THE DRAWINGS

The features, aspects, and advantages of the present invention will become better understood with regard to the following description, appended claims, and accompanying drawings in which:

DETAILED DESCRIPTION

Figure 1A:
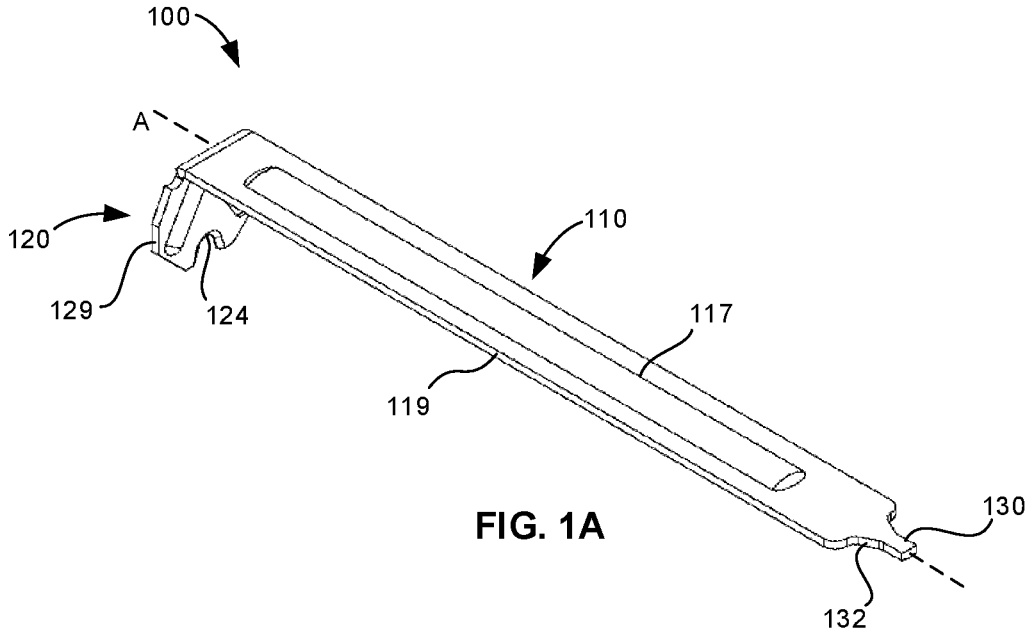
FIG. 1A is a perspective view of a pin removal tool according to an embodiment of the present disclosure.
Figure 1B:
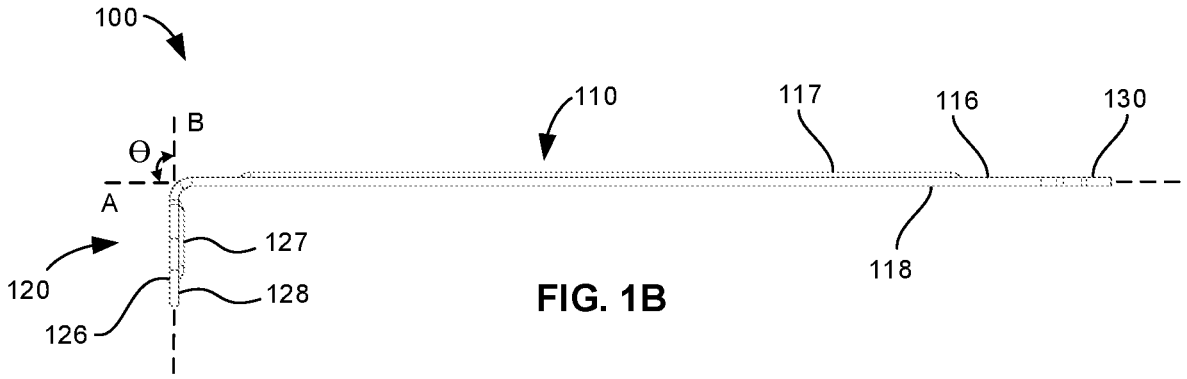
FIG. 1B is a front view of the pin removal tool of FIG. 1A.
Figure 1C:
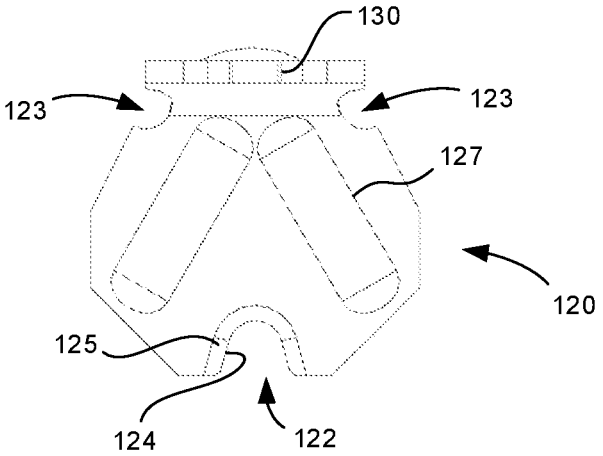
FIG. 1C is a right side elevational view of the pin removal tool of FIG. 1A.
Figure 2A:
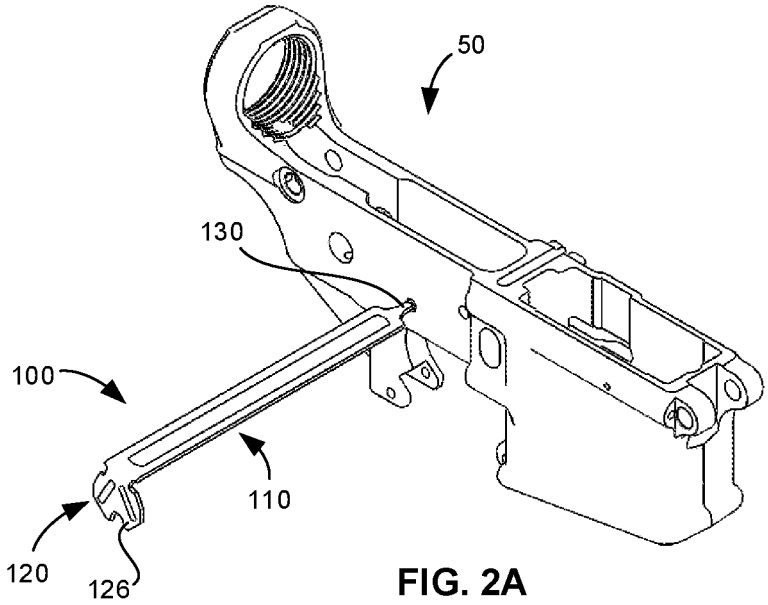
FIGS. 2A-2E depict a method of removing a pin from a firearm receiver using the pin removal tool of FIG. 1A.
Figure 2B:
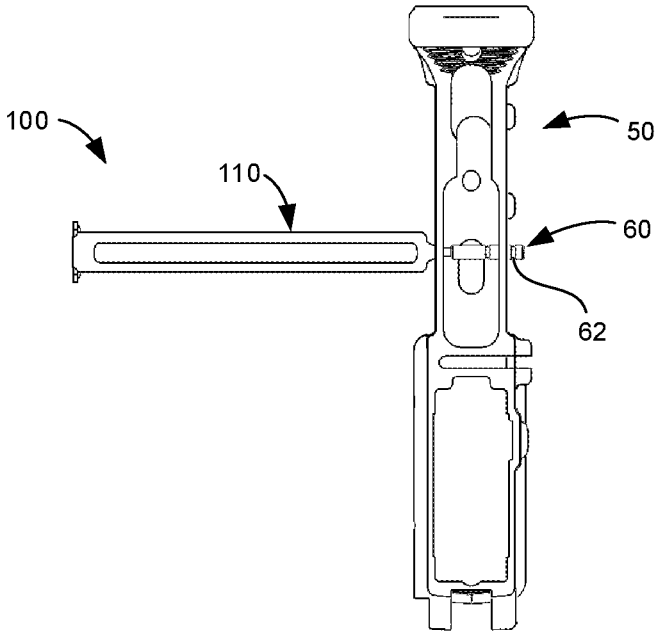
Figure 2C:
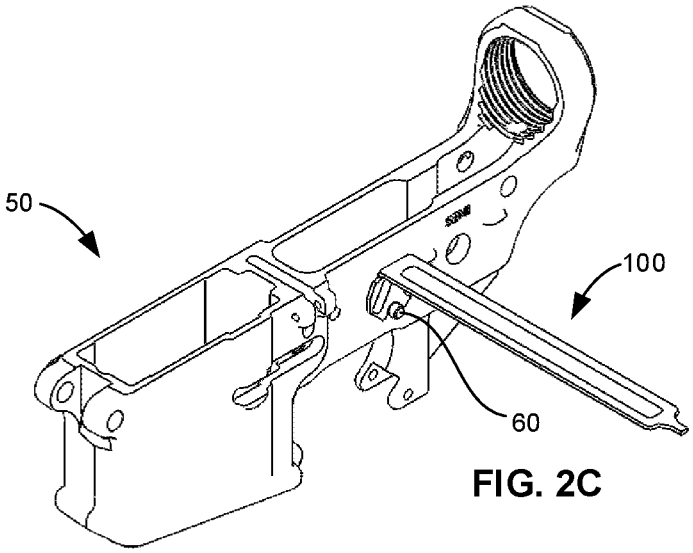
Figure 2E:
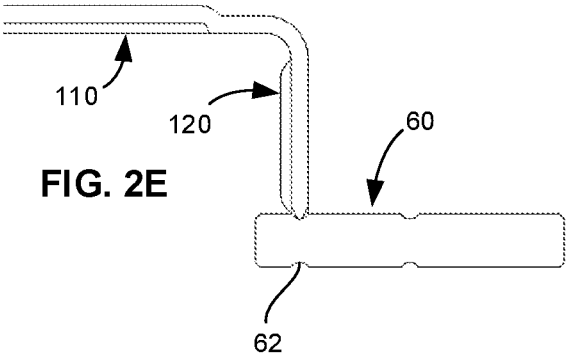
Figure 2D:
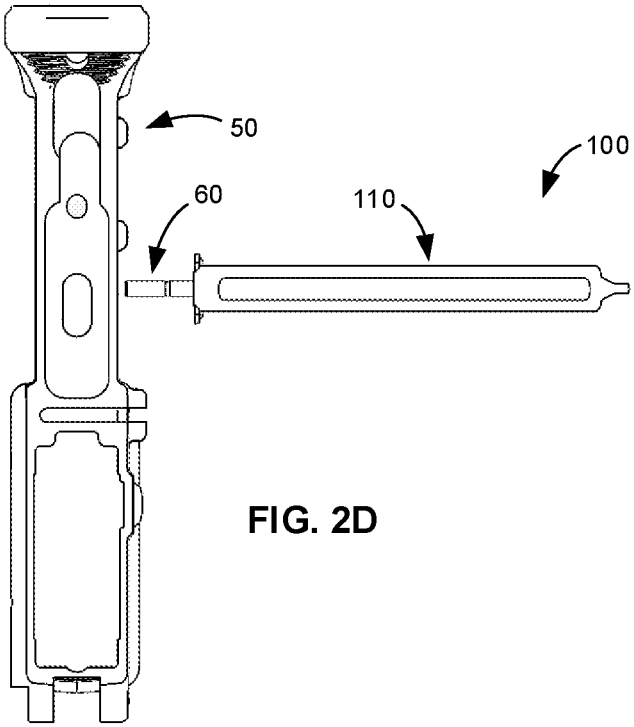

FIGS. 1A-1C depict a pin removal tool 100 according to an embodiment of the present disclosure. Pin removal tool 100 generally includes a shaft 110, a head 120, and a projection 130.

Handle 110 includes an upper surface or first surface 116 and lower surface or second surface 118. A sidewall 119 extends between upper and lower surfaces 116, 118 which defines a thickness of handle 110. Handle 110 is an elongate structure such that its length is greater than its width. In addition, handle 110 is flat such that its width is greater than its thickness. A longitudinal axis "A" extends along the length of handle 110. The width and thickness of handle 110 extend orthogonal to axis A. Upper and lower surfaces 116, 118 are generally planar. However, handle 110 may include a stiffening element 117 that is in the form of a depression or groove in lower surface 118 that projects as a rib extending from upper surface 116, as is best shown in FIG. 1A. Such stiffening element 117 provides stiffness to handle 110 so that handle 110 is not easily bent during use or otherwise.

Head 120 extends from a first end or distal end of handle 110. Head 120 has a first surface or front surface 126 and a second surface or rear surface 128. A sidewall 129 extends between front and rear surfaces 126, 128 which defines a thickness of head 120. A longitudinal axis "B" extends along a length of handle 110. Axis A and B are angled relative to each other by an angle θ. Angle θ is 90 degrees, as shown. However, other angles are contemplated, such as 45 and 60 degrees, for example. Head 120 has a polygonal shape but may have other shapes, such as circular, for example. Head 120, similar to handle 110, has a width greater than a thickness thereof and includes at least one stiffening element 127. In the embodiment depicted, head 120 includes two stiffening elements 127 in the form of depressions or grooves in front surface 126 that project as ribs extending from rear surface 128. Stiffening elements 127 extend at least partially along the length of head 120 and also along its width. In this regard, stiffening elements 127 are angled relative to axis B, but in some embodiments they may be parallel to axis B. Such stiffening elements 127 provide stiffness to head 120 so that head 120 is not easily bent during use or otherwise. Head 120 also includes an engagement notch 122 at its distal end remote from handle 110. Engagement notch 122 extends into head along axis B and is defined by a parabolic-shaped edge 124. Edge 124 includes inclined surfaces 125 that extend toward each other to form a wedge. Head 120 also includes junction notches 123 that are located at opposite sides of the width of head 120 and at the junction between handle 110 and head 110. Such junction notches 123 allow head 120 to be bent into position during manufacturing as described below.

Projection or punch 130 extends from a second end or proximal end of handle 110. Projection 130 extends along longitudinal axis A. In this regard, projection 130 and handle 110 are coplanar. In other words, axis A, handle 110, and projection 130 each lie in the same plane. In addition, projection 130 shares upper and lower surfaces 116, 118 with handle 110. Projection 130 has a width smaller than that of projection 130, but the same thickness as handle 110. The dimensions of projection 130 are configured so that projection 130 can be received within a pin opening of a device, such as a firearm. In addition, as shown, projection 130 may have a tapered base 132 which helps provide strength to projection 130 and also acts as a depth stop when inserting projection into a pin opening.

Tool 100 may be made from a multitude of different materials, but is preferably made out of metal and preferably a softer metal than a pin it is intended to remove to help prevent deformation of the pin. For example, tool 100 may be made from AISI 1035 steel. However, tool 100 may also be made from any other steels such as AISI 1018, AISI 1050, ASTM A36, and the like.

Tool 100 is made by stamping the tool's shape from a blank of metal material. In particular, a sheet of metal is inserted into a stamping machine (not shown) and a die is used to stamp the sheet of metal into the shape of tool 100 so that such shape includes handle 110, head 120, and projection 130. Thus, projection 130 is formed concurrently with head 120 and handle 110. Thereafter, head 120 is bent to the desired angle θ. During the stamping process stiffening elements 117, 127 are pressed into tool 100. In addition, notches 122, 123 are formed during the stamping process.

FIGS. 2A-2D depict a method of using pin removal tool 100 to remove a trigger pin 60 from a lower receiver 50 of an AR-15/M4 style rifle. Pin 60 may help hold a trigger assembly in place within the lower receiver 50. In order to remove pin 60 from lower receiver 50, projection 130 is placed against pin 60 within a pin opening of lower receiver 50. While holding handle 110, projection 130 is pushed on pin 60 which causes pin 60 to be dislodged and partially pushed out of the pin opening. Impaction should not be needed. In this regard, impaction stresses on the pin and tool are avoided. However, if absolutely necessary to help push pin from its seat in lower receiver 50, tool 100 can be impacted preferably as close to axis A as possible to avoid bending head 120 relative to axis A. Tool 100 is pushed against pin 60 until tapered base 132 of pin 130 or handle 110 abuts lower receiver 50 to prevent further movement of projection 130 into lower receiver 50. At this point, pin 60 should partially extend from lower receiver 50 so that a circumferential groove 62 thereof is exposed. Thereafter, tool 100 is turned around and moved to the opposite side of lower receiver 50. Head 120 is then engaged to pin 60 so that it is received within notch 122 and edge 124 is received within groove 62. The angle θ of head 120 relative to handle 110 in conjunction with the flat front face 126 of head 120 helps get notch 122 as close to lower receiver 50 as possible in order to engage pin 60. Tool 100 is then pulled along axis A which causes pin 60 to slide out of lower receiver 50 completely and in a controlled manner. Pin 60 can then be moved to a safe location until it is needed for reassembly.

Figure 3A:
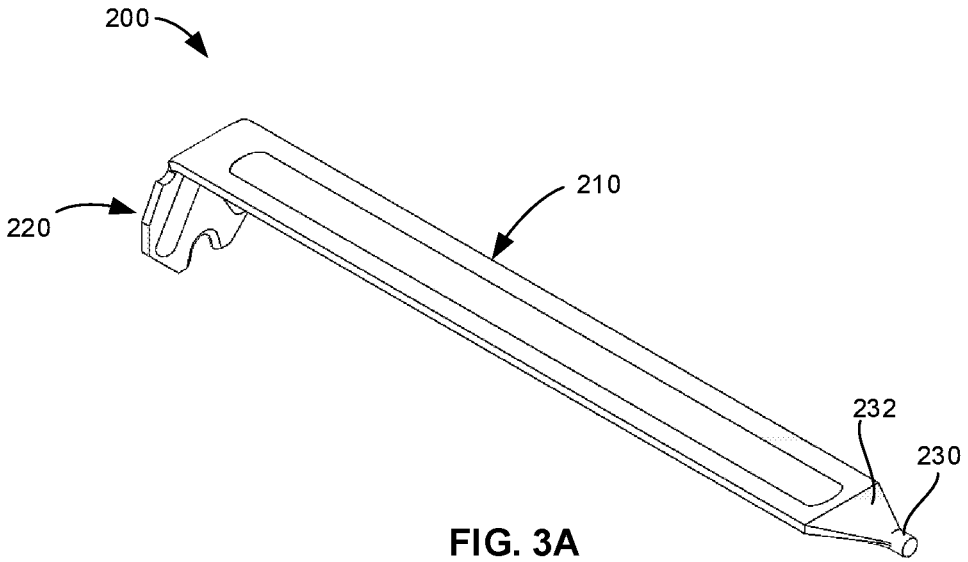
FIG. 3A is a perspective view of a pin removal tool according to another embodiment of the present disclosure.
Figure 3B:
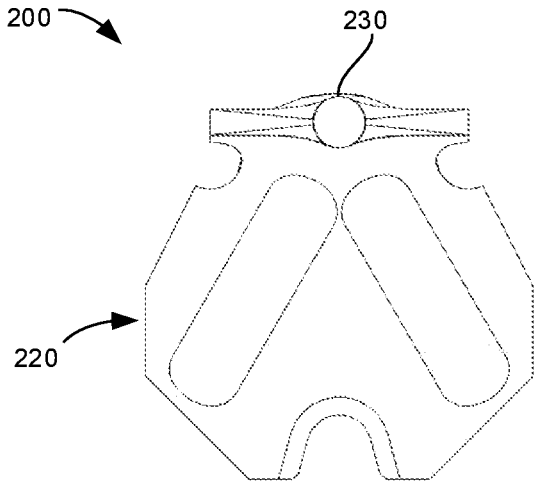
FIG. 3B is a right side elevational view of the pin removal tool of FIG. 3A.

FIGS. 3A and 3B depict another tool embodiment, pin removal tool 200. For ease of review, like elements will be accorded like reference numerals to that of tool 100, but within the 200-series of numbers. For instance, tool 200 includes a handle 210, head 220, and projection 230. However, tool 200 also differs with respect to projection 230. Projection 230 is a solid bar punch that is in the form of a cylindrical post that may be cold forged or machined to its final cylindrical shape. Projection 230 extends from a tapered section 232 that tapers from the proximal end of handle to projection 230.

Figure 4A:
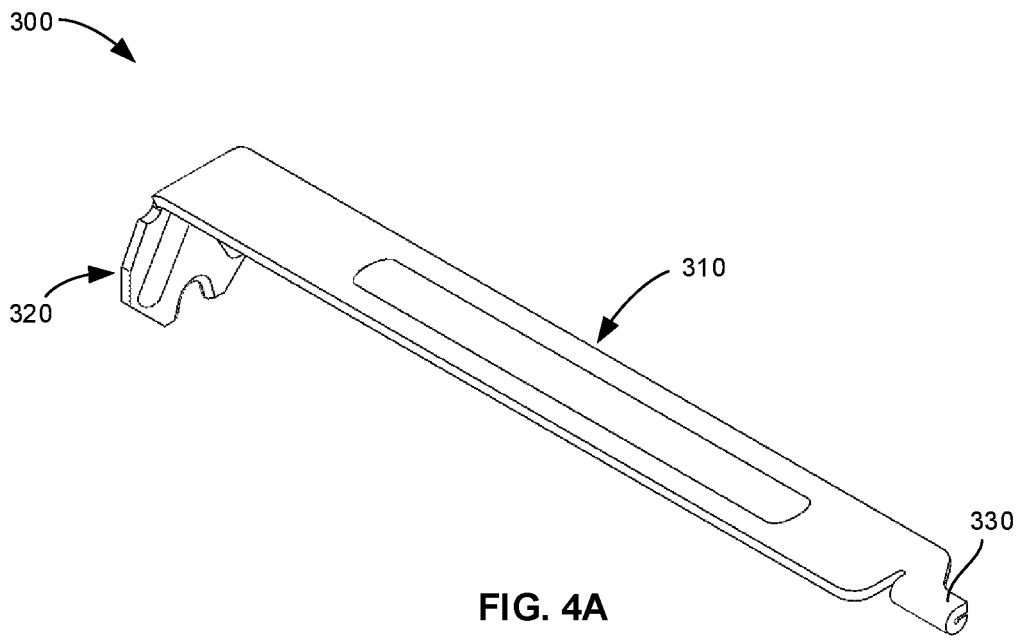
FIG. 4A is a perspective view of a pin removal tool according to a further embodiment of the present disclosure.
Figure 4B:
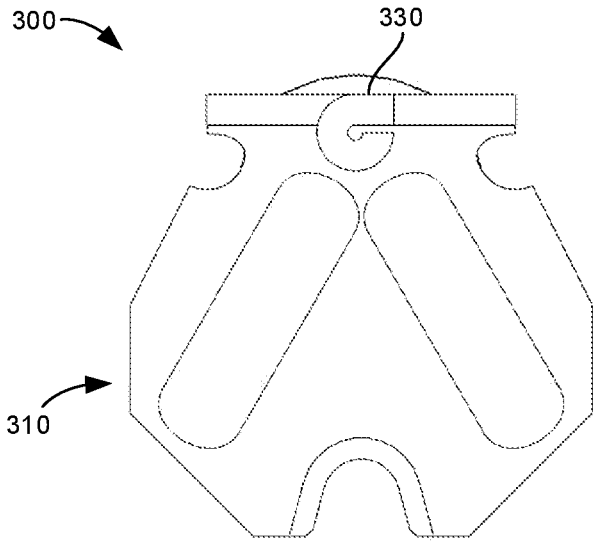
FIG. 4B is a right side elevational view of the pin removal tool of FIG. 4A.

FIGS. 4A and 4B depict another tool embodiment, pin removal tool 300. For ease of review, like elements will be accorded like reference numerals to that of tool 100, but within the 300-series of numbers. For instance, tool 300 includes a handle 310, head 320, and projection 330. However, tool 300 also differs with respect to projection 330. Tool 300 is formed in the same manner as that of tool 100. However, as tool 300 is stamped from a blank of material, the stamp die cuts a portion of the handle shape at the proximal end thereof. This portion is then rolled into a cylindrically-shaped projection 330 that is sized to punch a pin from a device. Thus, projection is formed both during and after the stamping process.

Figure 5A:
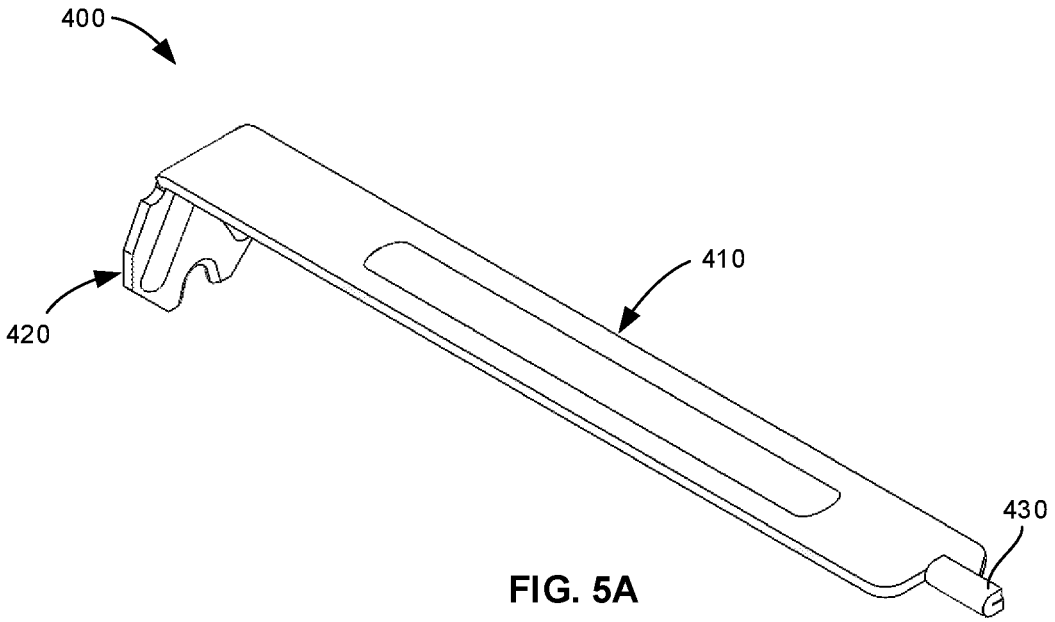
FIG. 5A is a perspective view of a pin removal tool according to yet another embodiment of the present disclosure.
Figure 5B:
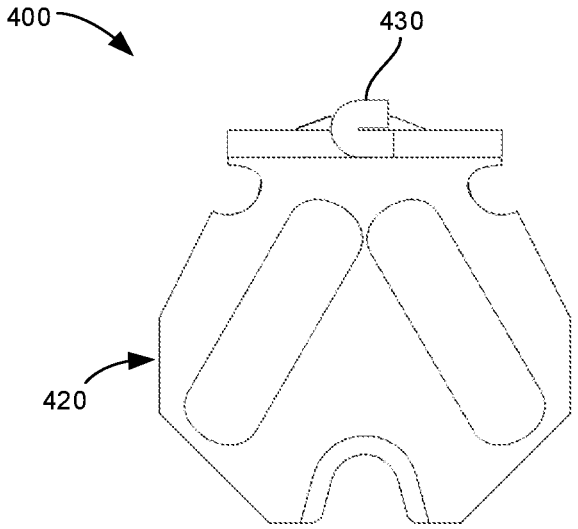
FIG. 5B is a right side elevational view of the pin removal tool of FIG. 5A.

FIGS. 5A and 5B depict another tool embodiment, pin removal tool 400. For ease of review, like elements will be accorded like reference numerals to that of tool 100, but within the 400-series of numbers. For instance, tool 400 includes a handle 410, head 420, and projection 430. However, 400 also differs with respect to the projection 430. Tool 400 is formed in the same manner as that of tool 100. However, as tool 400 is stamped from a blank of material, the stamp die cuts a portion of the handle shape at the proximal end thereof. This portion is then folded into a cylindrically-shaped projection 430 that is sized to punch a pin from a device. Thus, projection is formed both during and after the stamping process.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of removing a pin from a firearm, the pin securing a component of the firearm, comprising:

placing a projection of a pin removal tool against a first end of the pin of the firearm, the projection of the pin removal tool extending from a first end of a handle of the pin removal tool;

pushing the projection against the pin to cause the pin to partially unseat from its position within the firearm;

engaging the pin between the first end and a second end thereof with a notch of a head of the pin removal tool; and removing the pin from the firearm by pulling on the pin removal tool.

2. The method of claim 1, wherein the pin removal tool has a longitudinal axis extending from a first terminal end to a second terminal end thereof, the projection extending along the longitudinal axis and defining the first terminal end of the pin removal tool.

3. The method of claim 2, wherein the head defines the second terminal end of the pin removal tool.

4. The method of claim 1, wherein the head has a first side, a second side, and a wall extending between the first and second sides.

5. The method of claim 4, wherein the first side of the head has a planar surface oriented transverse to the longitudinal axis.

6. The method of claim 5, wherein the notch extends into the wall and through the first and second sides of the head.

7. The method of claim 6, wherein the notch tapers inwardly in a direction toward the longitudinal axis.

8. The method of claim 1, wherein pin removal tool is made from steel material selected from the group consisting of AISI 1035 steel, AISI 1050 steel, and ASTM A36 steel.

9. The method of claim 1, wherein engaging the pin includes inserting a wedge into a notch of the pin, the wedge defining at least a portion of a perimeter of the notch.

10. The method of claim 1, wherein the projection is made from steel material selected from the group consisting of AISI 1035 steel, AISI 1050 steel, and ASTM A36 steel.

11. The method of claim 1, wherein the pin is a trigger pin disposed in a lower receiver of the firearm and removing the pin from the firearm releases a trigger assembly within the lower receiver.

12. A method of removing a pin from a device, the pin securing a component of the device, comprising:

placing a projection of a pin removal tool against a first end of the pin and the device, the projection of the pin removal tool extending from a first end of a handle of the pin removal tool in a direction away from the head and along a longitudinal axis of the handle;

pushing projection against the pin to cause the pin to partially unseat from its position within the device;

engaging the pin between the first end and a second end thereof with a notch of a head of the pin removal tool; and pulling on the pin removal tool and the pin to remove the pin from the device.

* * * * *